US011786042B2

(12) United States Patent
Goldsmith

(10) Patent No.: US 11,786,042 B2
(45) Date of Patent: Oct. 17, 2023

(54) MODULAR HIGH-LOW BED

(71) Applicant: Decorah Bank & Trust Co., Executor of the Estate of Aaron Goldsmith, Decorah, IA (US)

(72) Inventor: Aaron Goldsmith, Postville, IA (US)

( * ) Notice: Subject to any disclaimer, the term of this patent is extended or adjusted under 35 U.S.C. 154(b) by 0 days.

(21) Appl. No.: 17/169,003

(22) Filed: Feb. 5, 2021

(65) Prior Publication Data

US 2021/0251390 A1 Aug. 19, 2021

Related U.S. Application Data

(60) Provisional application No. 62/978,559, filed on Feb. 19, 2020.

(51) Int. Cl.

| | |
|---|---|
| ***A47C 19/04*** | (2006.01) |
| ***A47C 19/14*** | (2006.01) |
| ***A47C 19/02*** | (2006.01) |

(52) U.S. Cl.

CPC ..... *A47C 19/045* (2013.01); *A47C 19/021* (2013.01); *A47C 19/14* (2013.01)

(58) Field of Classification Search

CPC ..... A47C 19/045; A47C 19/021; A47C 19/14; A47C 20/041

USPC ..... 5/611

See application file for complete search history.

(56) References Cited

U.S. PATENT DOCUMENTS

| | | | | |
|---|---|---|---|---|
| 2,072,791 | A * | 3/1937 | Baer | A47C 19/024 248/407 |
| 2,592,166 | A * | 4/1952 | McLean | A61G 7/012 5/11 |
| 6,089,593 | A * | 7/2000 | Hanson | A61G 7/0528 297/85 L |
| 7,996,939 | B2 * | 8/2011 | Benedict | A61G 1/0237 5/614 |
| 8,069,511 | B1 * | 12/2011 | DiMucci | A61G 7/012 5/11 |
| 2002/0056162 | A1 * | 5/2002 | Flynn | A61G 1/0287 5/617 |
| 2003/0093863 | A1 * | 5/2003 | Grove | A61G 7/053 5/618 |
| 2007/0169268 | A1 * | 7/2007 | Lemire | A61G 7/0524 5/617 |
| 2011/0271446 | A1 * | 11/2011 | Shih | A47C 20/041 5/174 |
| 2012/0167299 | A1 * | 7/2012 | Tarquinio | A47C 19/045 5/93.1 |
| 2014/0317848 | A1 * | 10/2014 | Kay | A61G 7/018 5/618 |
| 2014/0325759 | A1 * | 11/2014 | Bly | A61G 7/015 5/613 |
| 2014/0331409 | A1 * | 11/2014 | Day | A61G 13/0018 5/622 |
| 2015/0283017 | A1 * | 10/2015 | Harris, Jr. | A61G 13/10 5/611 |
| 2015/0290059 | A1 * | 10/2015 | Brosnan | A47C 20/041 5/616 |

(Continued)

*Primary Examiner* — David R Hare
*Assistant Examiner* — Luke Hall
(74) *Attorney, Agent, or Firm* — SHUTTLEWORTH & INGERSOLL, PLC; Jason Sytsma

(57) ABSTRACT

A frame and a selectably attachable platform and a selectably attachable head-foot module where only one of the selectably attachable platform and the selectably attachable head-foot module is combined to the frame at a time.

18 Claims, 9 Drawing Sheets

(56) References Cited

U.S. PATENT DOCUMENTS

| | | | | |
|---|---|---|---|---|
| 2018/0344551 | A1* | 12/2018 | Huang | A47C 19/045 |
| 2020/0214463 | A1* | 7/2020 | Xie | A47C 20/041 |
| 2021/0169720 | A1* | 6/2021 | Diaz-Hellin Nicolas | A61G 7/012 |

* cited by examiner

MODULAR HIGH-LOW BED

The present application claims the benefit of U.S. Provisional Patent Application No. 62/978,559 filed Feb. 19, 2020, the contents of which are hereby incorporated herein by reference.

The present invention generally concerns adjustable beds where the contour of the upper surface of the bed is adjustable, and high-low adjustable beds that are adjustable in elevation above a floor as well as in contour. The present invention particularly concerns adjustable, and high-low adjustable, beds that sell, ship, and assemble as modules.

BACKGROUND INFORMATION

An adjustable bed can be positioned in multiple positions. High-low bed can raise up and down with respect to the floor. A head/foot adjustable bed, as the name implies, has an adjustable contour where the head and foot sections of the bed are each adjustable with respect to each other. Common adjustment includes inclining the upper body and raising the lower body independently of each other. Other common features include height adjustment and tilting the bed to raise the upper body or the lower body.

Adjustable beds have been used in hospitals for a long time, but have become more commonly used in home care over the past three decades, as they have been found to provide relief from various conditions. The increased popularity of motorized adjustable beds for home care is also partly due to the benefits provided to the care giver, by allowing them to work at a comfortable height and reduce the risk of back injuries. Height adjustment and raising the upper body also assists users in getting out of bed with little or no assistance dependent on their condition.

Designs have been proposed to lessen the expense of shipping these beds to the user. Prior designs, however, have failed to provide an economically feasible solution that can be used in the home as the patient progresses in degrees of infirmity. Typically, a patient may transition from a standard bed to a high-low bed because he/she needs assistance getting into the bed but does not yet require the functionality of head-foot adjustability. As the patient's infirmity progresses, he/she may need the functionality of head-foot adjustability for pain relief. The only option, however, is to purchase an adjustable bed with all of this functionality.

The present invention will be seen to teach a system for connecting modular sections of an adjustable bed in such a simplified manner that it lends itself to being easily assembled by a single person with minimal tooling yet with a frame that maintains its strength and rigidity.

SUMMARY

Disclosed is a modular high-low bed comprising of a frame and a selectably attachable platform and a selectably attachable head-foot module where only one of the selectably attachable platform and the selectably attachable head-foot module is combined to the frame at a time. The modularity of the foregoing components simplifies and reduces the costs of shipping and means a patient can use this system as his/her health deteriorates with less expense. The patient can begin with the base high-low adjustable bed frame and selectably attachable platform. This can be used with the patient's existing headboard, footboard, and mattress to keep the aesthetics and comfort the patient is used to while giving them the convenience of a high low adjustability bed. If the patient's condition deteriorates and the patient needs the added benefits of the head-foot adjustability, the adjustable platform can be removed from the frame 100 and the head-foot module can be attached.

The frame can comprise a top section and a bottom section connected together by a lift mechanism to raise the top section with respect to the bottom section. The lift mechanism can comprises of a hinge assembly that raises the top section linearly upward with respect to the bottom section. In one implementation, the hinge assembly can comprise two pairs of hinged cross bars on opposite lateral sides of the frame and connected together at a pivot point. Each end of the two pairs of hinged cross bars can be connected to a slide combined to the respective top section and the bottom section so that when the two pairs of hinged cross bars pivot at the pivot point the respective ends move linearly toward each other to raise the top section with respect to the bottom section and linearly away from each other to lower the top section toward the bottom section. A cylinder can be combined at one end to a first cross bar extending between the two pairs of hinged cross bars and at the other end to a second cross bar extending opposing slides on one side of the bottom section of the frame.

The selectably attachable platform can comprises two lateral extensions that attach to the longitudinal sides of the top section of the frame to increase the lateral width of the fame. A plurality of attachable boards can be attached so that they extend across and are attachable to each of the lateral extensions for receiving the mattress.

The selectably attachable head-foot module can comprise a head section and a foot section combined together by a hinge that allows the head section and the foot section to pivot on top of each other for shipping in a more compact space. A locking mechanism can be provided to lock the head section and the foot section together to increase a load capacity of the selectably attachable head-foot module. The locking mechanism can comprise of a bayonet lock comprising a slidable bolt that slides linearly in a first tube and selectively combines to a second tube to lock the head section and the foot section together.

BRIEF DESCRIPTION OF THE DRAWINGS

These and other features and advantages of the present invention will be better understood by reading the following detailed description, taken together with the drawings wherein.

DETAILED DESCRIPTION OF THE PREFERRED EMBODIMENTS

Figure 1:
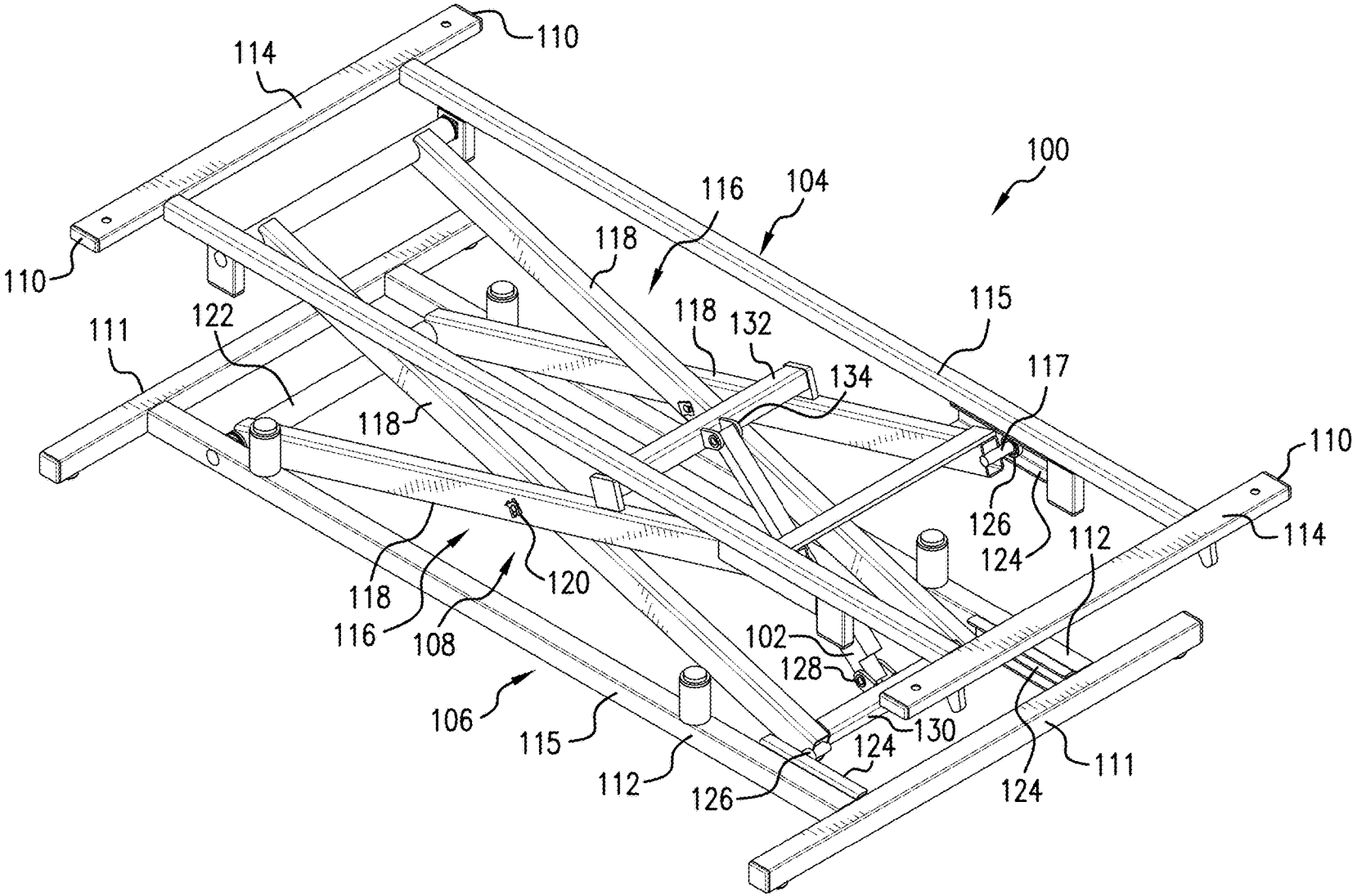
FIG. 1 is a perspective view of a frame for a high-low adjustable bed.
Figure 2:
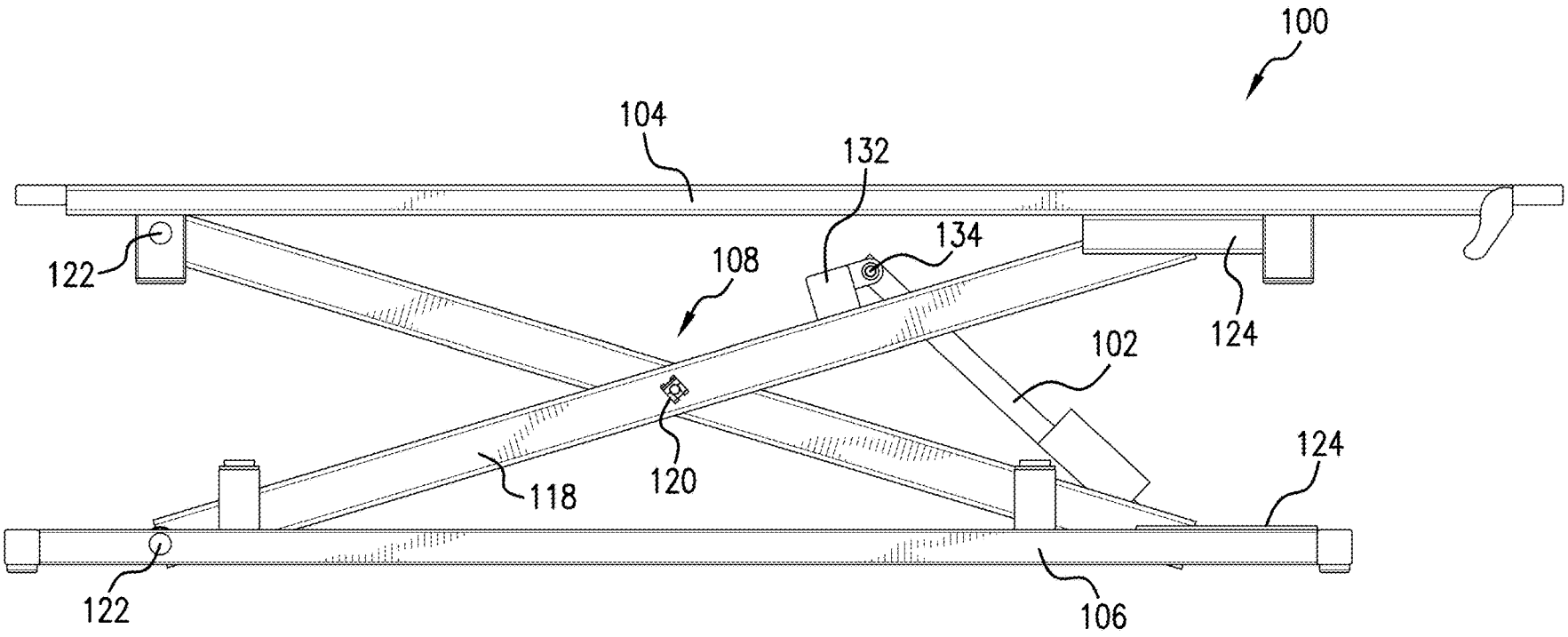
FIG. 2 is a side view of the frame of FIG. 1.
Figure 3:
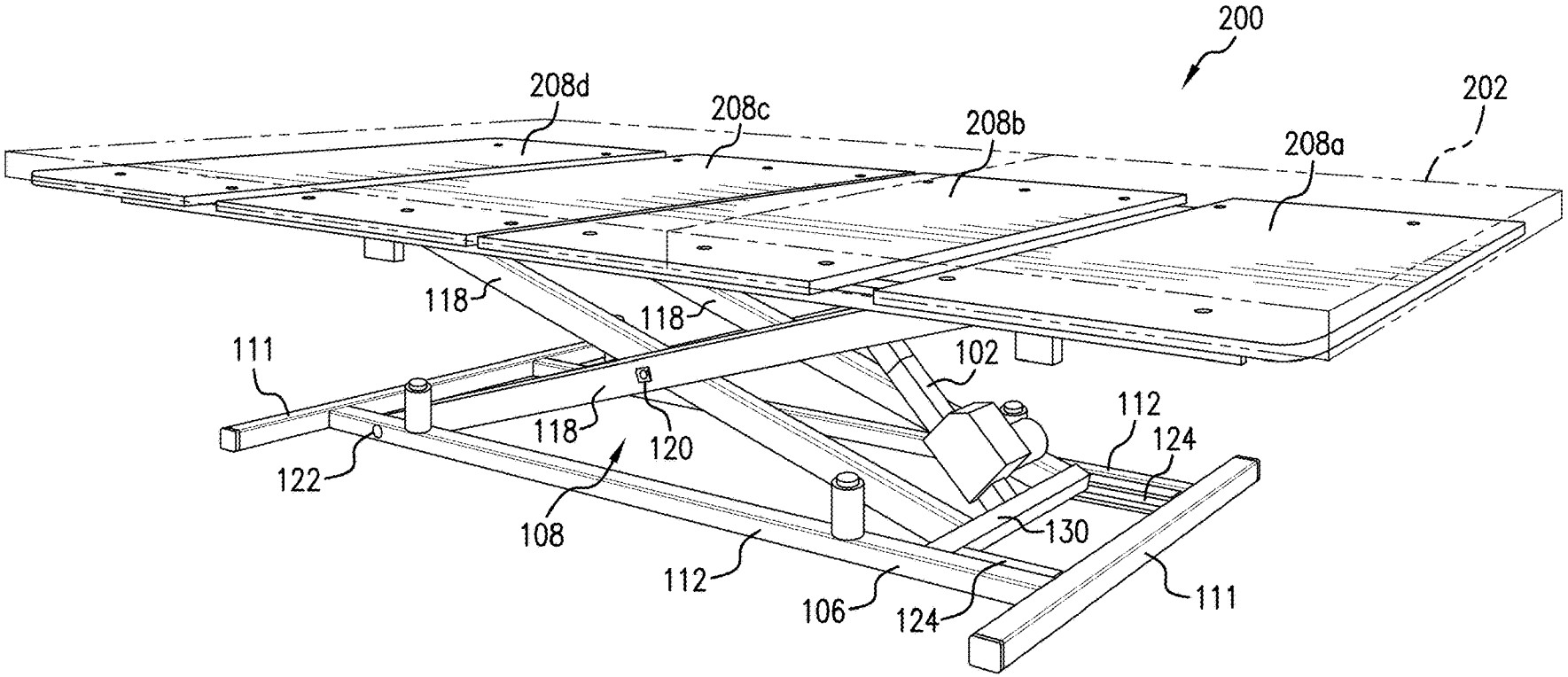
FIG. 3 is a first state of a high low adjustable bed with the frame of FIG. 1 in the raised position.
Figure 4:
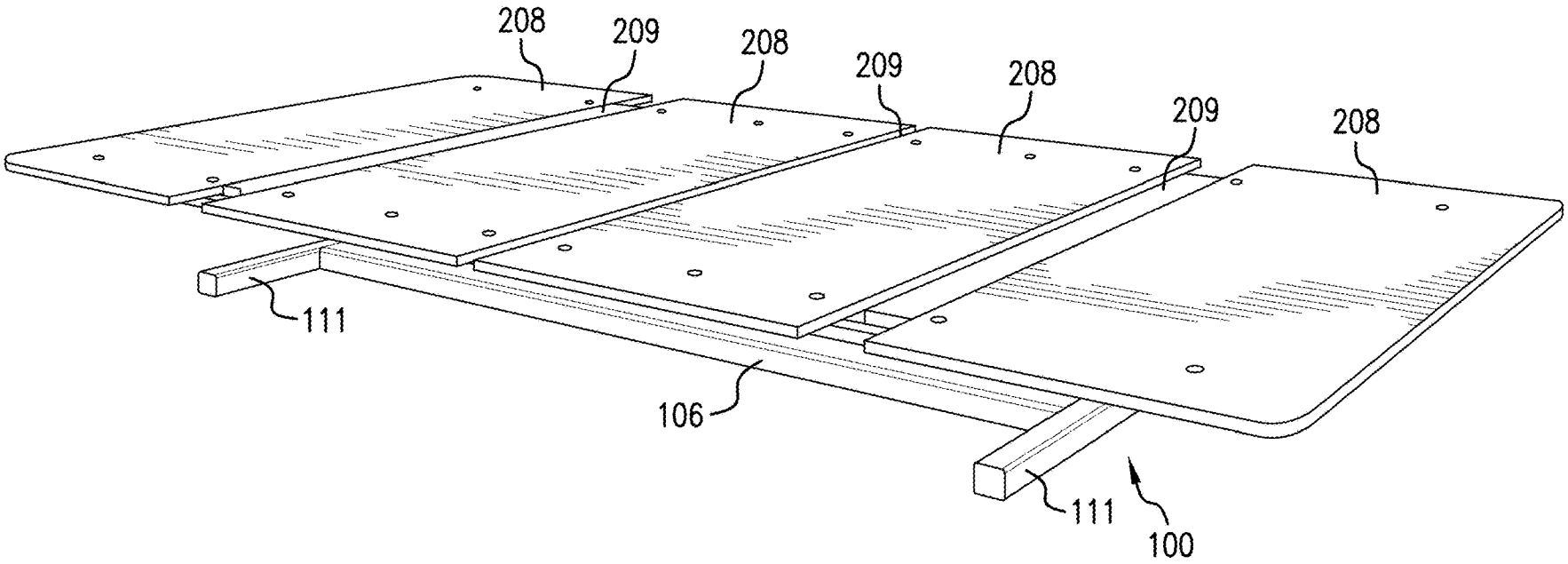
FIG. 4 is the high low adjustable bed of FIG. 3 in the lowered position.
Figure 5:
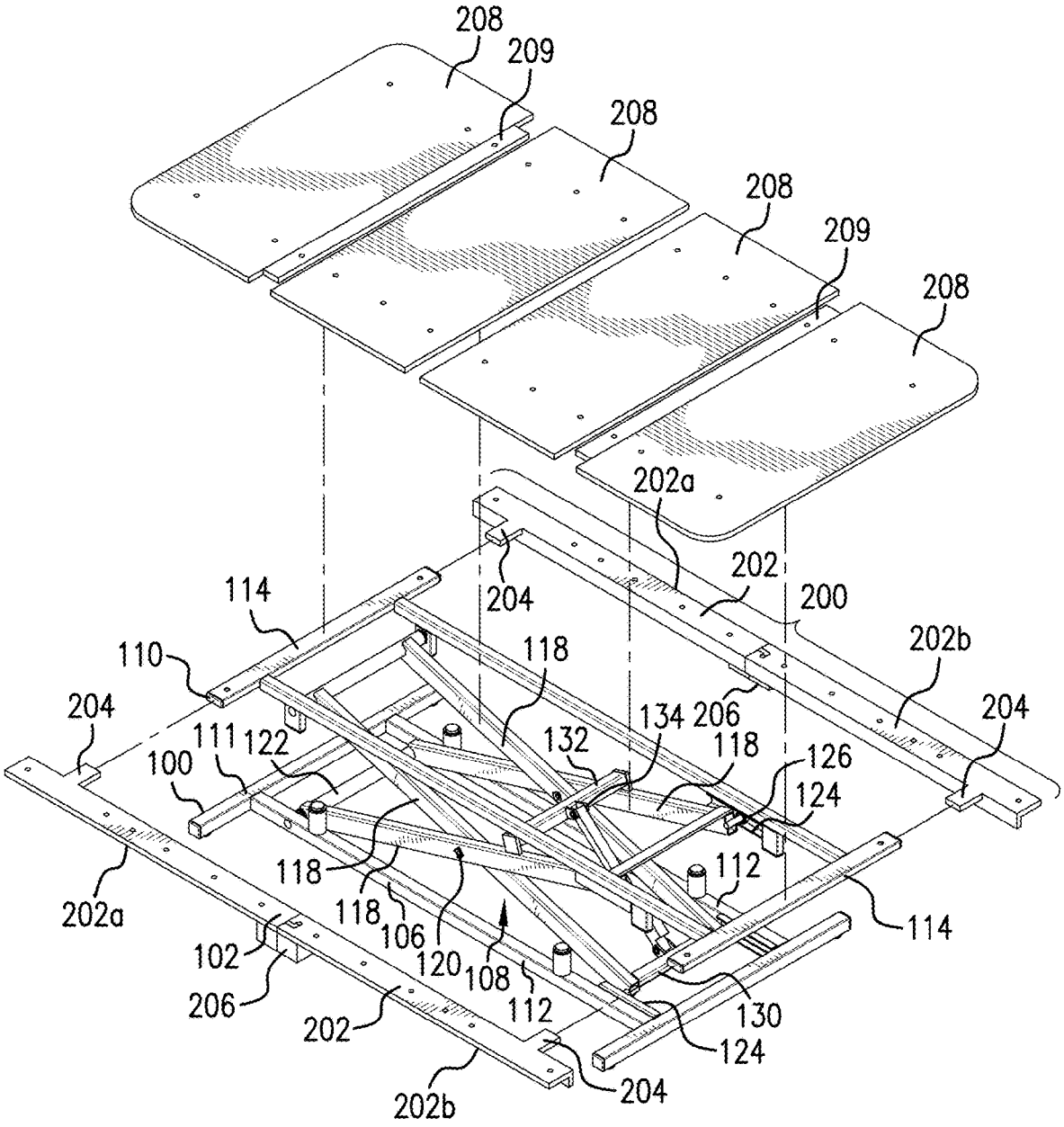
FIG. 5 is an exploded view of the high low adjustable bed of FIG. 3.
Figure 6:
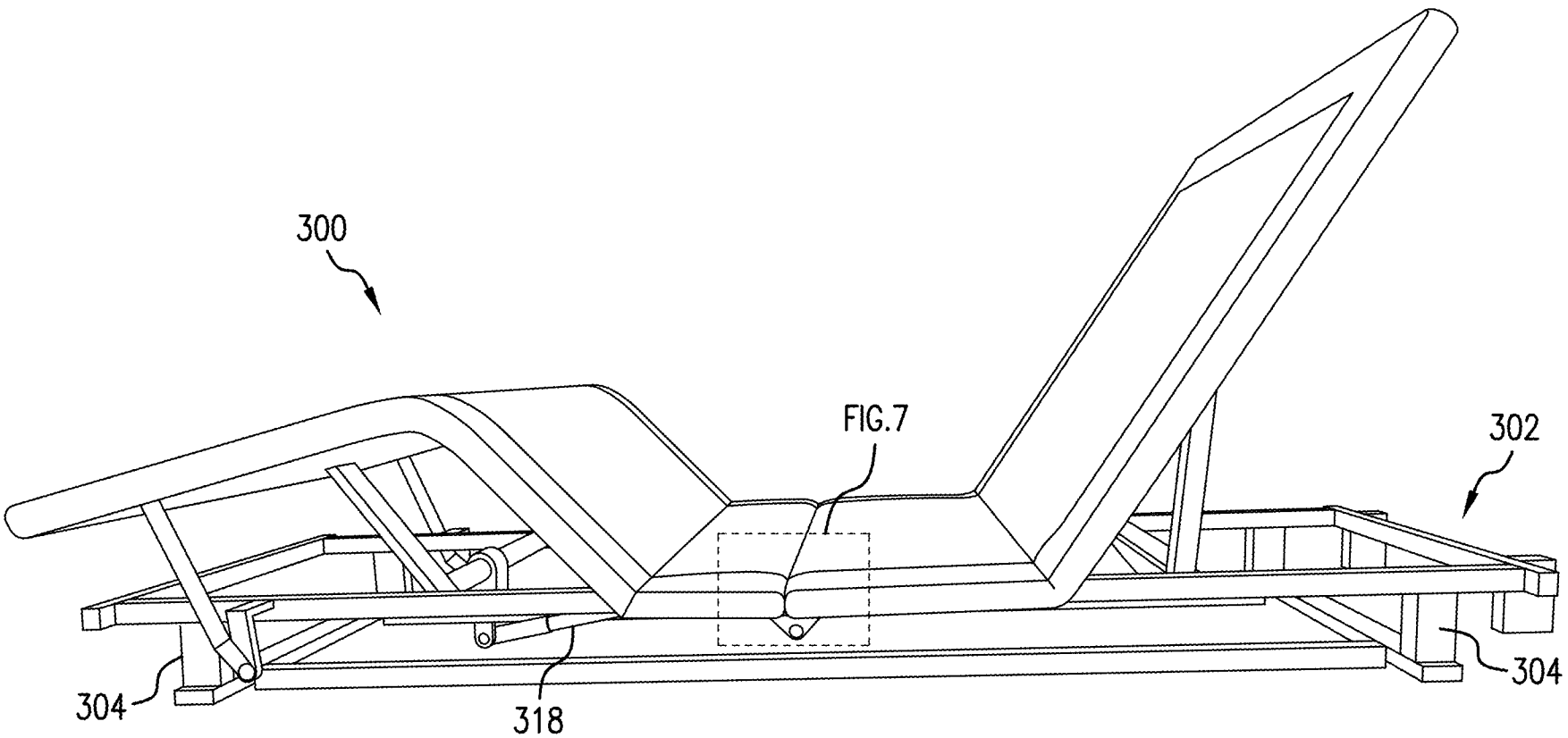
FIG. 6 is a head/foot module in a contoured position.
Figure 7:
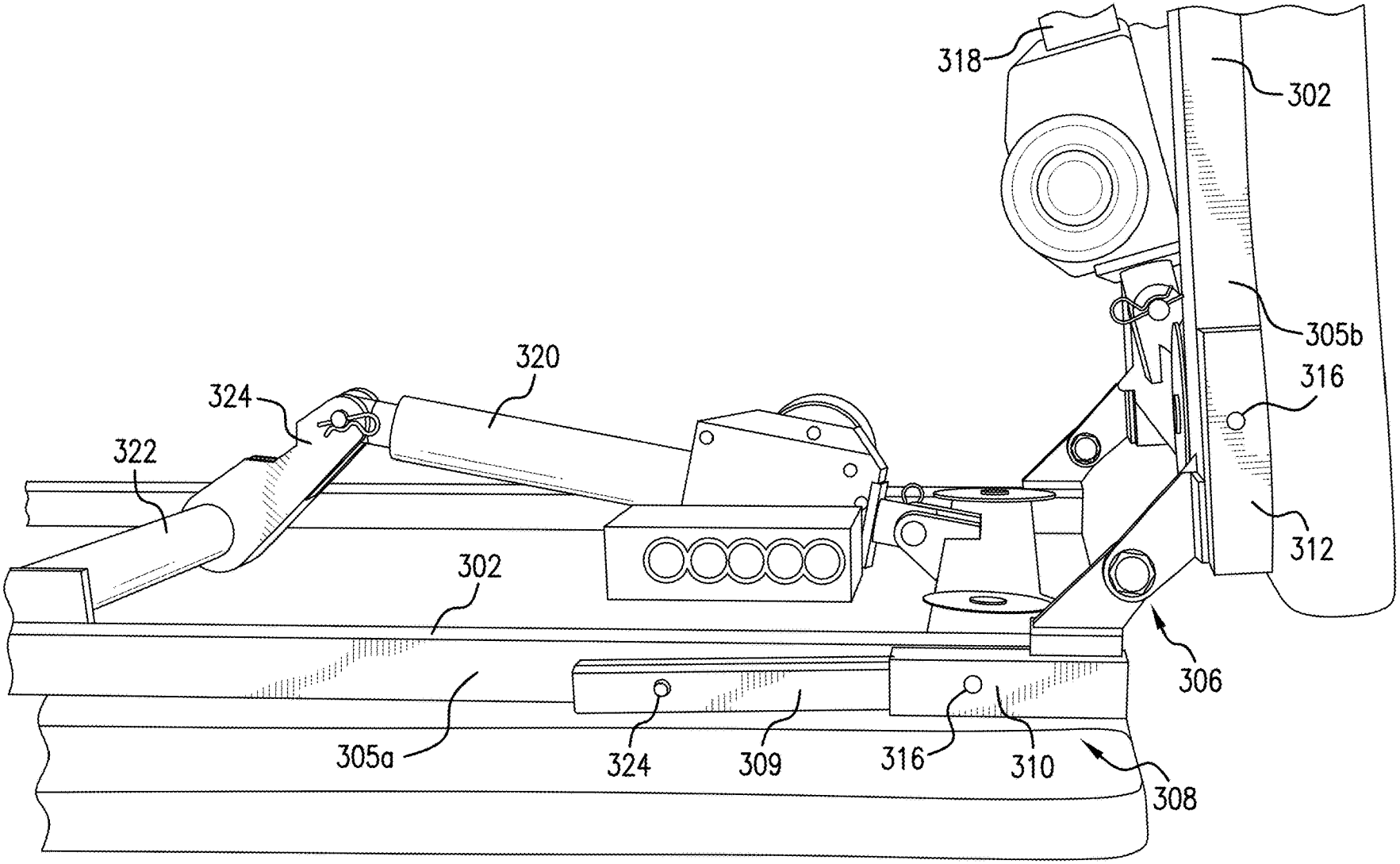
FIG. 7 is a close up view of the area shown in FIG. 6.
Figure 8:
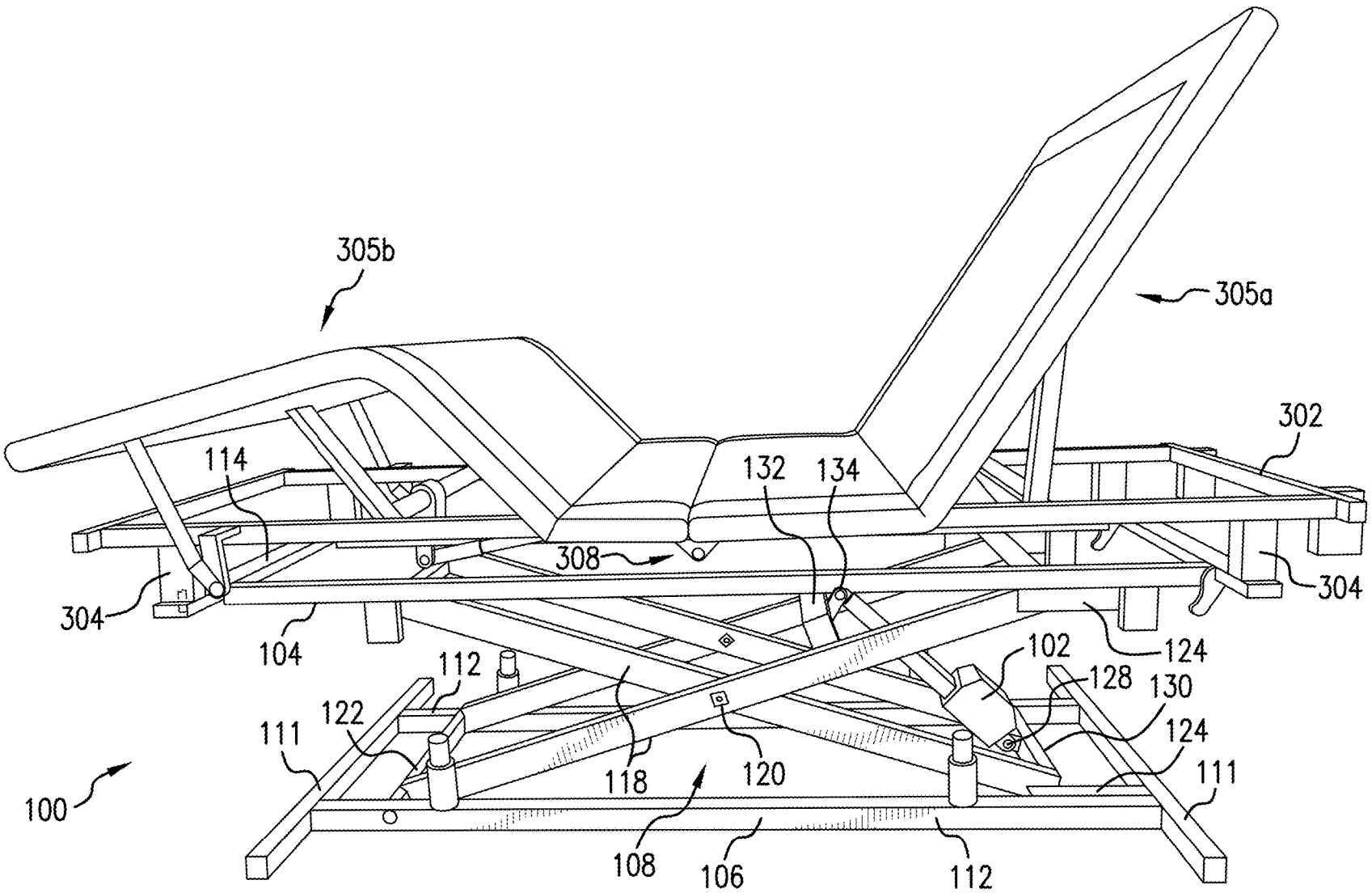
FIG. 8 is a second state of a high low adjustable bed with the head/foot module of FIG. 6 in the contoured position.

Referring to FIG. 1 is a frame 100 for a high-low adjustable bed shown in FIG. 3 and for a head/foot high low adjustable bed shown in FIG. 6. Frame 100 is the base section for modularity that provides a base for the high-low adjustable bed with a platform to support the patient's mattress (as shown in FIGS. 3-5). If the patient's infirmity progresses to the point of requiring head-foot adjustability, platform 200, shown in FIG. 3, can be removed and replaced with head-foot module 300, which is shown in FIGS. 6-8. This solution is a cost savings for the patient as he/she can purchase the additional functionality, if and when it is required, which can then be modularly attached to frame 100.

Frame 100 includes a top section 104 and a bottom section 106 connected by a lift mechanism 108. Top section 104 moves linearly straight up and down with respect to bottom section 106 by a cylinder 102. More specifically, bottom section 106 can comprises a pair of lateral tubes 111 separated by a pair of longitudinal tubes 112, which provides a rigid and sturdy foundation for frame 100. Similarly, top section 104 comprises of a pair of lateral tubes 114 separated by a pair of longitudinal tubes 115 to provide a similarly rigid and sturdy frame for a mattress 201 (shown in phantom in FIG. 3) or head-foot module 300 (shown in FIGS. 6-8).

Movement of frame 100 is provided by lift mechanism 108, which in one embodiment can be a scissor hinge assembly, which can comprise of two pairs of hinge assemblies 116 each of which comprises of a pair of hinged cross bars 118. Hinged cross bars pivot about a center point 120. Respective hinged cross bars 118 are joined together by a roller bearing 122 at one end and are engaged in a slide 124 at the other end. A wheel 126 is attached by a rod 117 to an end of each of the respective hinged cross bars 118 and places wheel 126 is engagement with slide 124 for linear movement of wheel 126 about slide 124. Cylinder 102 is pivotally attached at a hinge 128 to a cross bar 130 extending between respective hinged cross bars 118 where they are connected to the respective slide 124 and the other end by a similar hinge 134 to a cross bar 132 extending between hinged cross bars 118. This arrangement allows cylinder 102 to drive lift mechanism 108 to raise and lower top section 104.

Frame 100 is converted in to a high low bed by adding platform 200 to frame 100. As shown in FIG. 5, top section 104 of frame 100 has end caps 110 that seal each end of the two lateral tubes 114. When adding platform 200 to frame 100, end caps 110 are removed and a lateral extension 202 is attached to opposite sides of frame 100. Lateral extension 202 has a member 204 on each end that fits into lateral tubes 114 when end caps 110 were removed. Lateral extension 202 increases the width of top section 104 of frame 100 to receive boards 208 (discussed below). Lateral extension 202 also can be disassembled into 2 sections 202*a*, 202*b* for easy shipping and reassembled by a bayonet lock 206.

As stated above, platform 200 can comprise multiple boards 208 separated by spacers 209 that can be attached to each lateral extension 202 to provide a platform for a mattress 201 (shown in FIG. 3). Spacers 209 are added to increase the length of platform 200 for longer beds. Spacers 209 can be removed and multiple boards 208 can be attached adjacent to each other for shorter beds. Because of the compact spacing of frame 100 and adjustable platform 200, this unit can fit inside an existing head and foot board area to keep the aesthetics of the bed.

Figure 9:
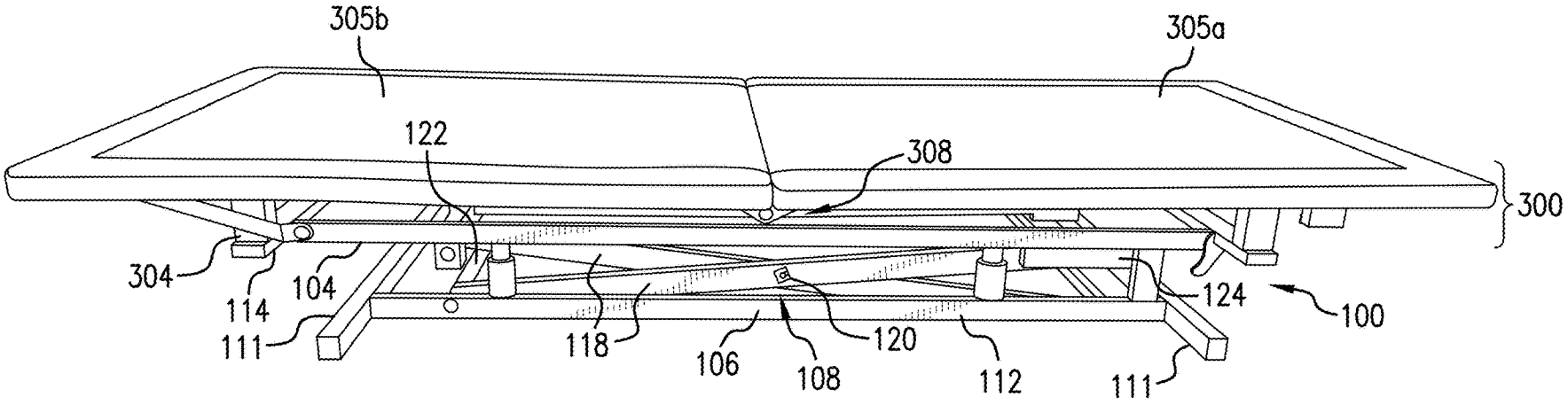
FIG. 9 the second state of the high low adjustable bed of FIG. 8 with the frame in the lowered position and the head/foot module in the lowered position.

When the patient is ready for head-foot adjustability, adjustable platform 200 can be removed from frame 100 and head-foot module 300, shown in FIG. 6, can be attached on top of frame 100, as shown in FIGS. 8-9. Head-foot module 300 has a bottom section 302 with legs 304 that have a threaded stud on the underside to correspond with mating holes on top section 104 of frame 100 to attach the respective sections together by a fixture, such as a bolt.

Head-foot module 300 comes in two sections 305*a*, 305*b* (a head section 305*a* and a foot section 305*b*) connected together by a hinge 306 so that it can be shipped with the sections 305*a*, 305*b* on top of each other for a more compact space. On the side of each of two sections 305*a*, 305*b* is a bayonet lock 308 comprising a slidable tube 309 that is slidable in a first welded tube 310 and lockable into a second welded tube 312. A pair of biased pins 324 on slidable tube 309 fit into corresponding receivers 316 to lock slidable tube 309 to the corresponding first welded tube 310 and second welded tube 312. Bayonet lock 308 also takes the weight off of hinge 306 so that head-foot module 300 can bear the weight of a person without additional structural supports.

Head-foot module 300 comprises a head actuating cylinder 318 and a foot actuating cylinder 320. Referring to FIG. 7, one end of each of head actuating cylinder 318 and foot actuating cylinder 320 is pivotally attached to the respective ends of bottom section 302. The other end of the respective head actuating cylinder 318 and foot actuating cylinder 320 is pivotally connected to a respective lateral rod 322 by a member 324. As illustrated in FIG. 8, each of head actuating cylinder 318 and foot actuating cylinder 320 independently raises and lowers the respective head section 305*a* and foot section 305*b* with respect to bottom section 302 of head-foot module 300. An alternative position can be seen in FIG. 9, with respective head section 305*a* and foot section 305*b* are lowered.

Head-foot module 300 can also be configured as a stand-alone bed without the high-low functionality provided by frame 100. Legs 304 can be configured to receive extensions or spacers to increase the length of legs 304 at least sufficient for the actuators to operate under the bed without bottoming out against the floor.

The modularity of the foregoing components allows for ease of shipping which reduces costs. The modularity also means a patient can use this system as his/her health deteriorates with less expense. The patient can begin with frame 100 and platform 200. This can be used with the patient's existing headboard, footboard, and mattress to keep the aesthetics and comfort the patient is used to while giving them the convenience of a high low adjustability for the bed. If the patient needs the added benefits of the head-foot adjustability, the adjustable platform 200 can be removed from frame 100 and the head-foot module 300 can be attached on top.

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. For example, while cylinders for moving various parts of the frame are shown and described, those skilled in the art would recognize that such cylinders can by hydraulic, pneumatic, or electric motors or actuators. Modifications and substitutions by one of ordinary skill in the art are considered to be within the scope of the present invention, which is not to be limited except by the following claims.

I claim:

1. A modular high-low bed comprising:

a frame comprising a top section and a bottom-frame section connected together by a lift mechanism to raise the top section with respect to the bottom-frame section; a first state comprising a separately, selectably attachable platform combinable, directly to the top section of the frame in the first state for receiving a mattress thereon; and a second state comprising a separately, selectably attachable head-foot module comprising a bottom section, legs extending downward from the bottom section that are combinable, directly to the top section of the frame in the second state, and a head section and a foot section combined to the bottom section of the head-foot module and each head section and foot section independently adjustable with respect to each other and with respect to the bottom section of the head-foot module and with respect to the top section of the frame, wherein the separately, selectably attachable platform is removed from the frame in the second state and wherein the head-foot module is removed from the frame in the first state.

2. The modular high-low bed of claim 1, wherein the lift mechanism of the frame further comprises of a hinge assembly that raises the top section linearly upward with respect to the bottom-frame section.

3. The modular high-low bed of claim 2, wherein the hinge assembly further comprises of two pairs of hinged cross bars on opposite lateral sides of the frame wherein each of the two pairs of hinged cross bars are connected together at a pivot point and each end of the two pairs of hinged cross bars are connected to a slide combined to the respective top section and the bottom-frame section so that when the two pairs of hinged cross bars pivot at the pivot point the respective ends move linearly toward each other to raise the top section with respect to the bottom-frame section and linearly away from each other to lower the top section toward the bottom-frame section.

4. The modular high-low bed of claim 3, further comprising a wheel combined to a rod which is fixed to one of each respective end of the two pairs of hinged cross bars wherein the wheel is engaged in the slide.

5. The modular high-low bed of claim 3, further comprising a cylinder combined at one end to a first cross bar extending between the two pairs of hinged cross bars and at the other end to a second cross bar extending opposing slides on one side of the bottom-frame section of the frame.

6. The modular high-low bed of claim 1, wherein the separately, selectably attachable platform comprises a lateral extension that attach to each of the longitudinal sides of the top section of the frame to increase the lateral width of the frame.

7. The modular high-low bed of claim 6, further comprising a plurality of attachable boards extending across and attachable to each of the lateral extensions for receiving a mattress thereon.

8. The modular high-low bed of claim 1, wherein the head section and the foot section of the head-foot module are combined together by a hinge that allows the head section and the foot section to pivot on top of each other for shipping in a more compact space.

9. The modular high-low bed of claim 8, wherein the separately, selectably attachable head-foot module further comprises of a locking mechanism to lock the head section and the foot section together to increase a load capacity of the separately, selectably attachable head-foot module.

10. The modular high-low bed of claim 9, wherein the locking mechanism comprises of a bayonet lock comprising a slidable bolt that slides linearly in a first tube and selectively combines to a second tube to lock the head section and the foot section together.

11. The modular high-low bed of claim 1, wherein the separately, selectably attachable head-foot module further comprises a head actuating cylinder and a foot actuating cylinder to raise and lower the respective head section and the foot section with respect to each other and with respect to the frame.

12. The modular high-low bed of claim 11, wherein the head actuating cylinder is pivotally connected to a bottom section of the separately, selectably attachable head-foot module and the other end is pivotally connected to a lateral rod that extends across the bottom section.

13. The modular high-low bed of claim 1, wherein each of the separately, selectably attachable platform and the separately, selectably attachable head-foot module is capable of being removably attached to the frame one at a time.

14. A modular high-low bed comprising:

a frame comprising a top section and a bottom-frame section connected together by a lift mechanism comprising a hinge assembly that raises the top section linearly upward with respect to the bottom-frame section, wherein the hinge assembly further comprises of two pairs of hinged cross bars on opposite lateral sides of the frame wherein each of the two pairs of hinged cross bars are connected together at a pivot point and each end of the two pairs of hinged cross bars are connected to a slide combined to the respective top section and the bottom-frame section so that when the two pairs of hinged cross bars pivot at the pivot point the respective ends move linearly toward each other to raise the top section with respect to the bottom-frame section and linearly away from each other to lower the top section toward the bottom-frame section; a first state comprising a separately, selectably attachable platform comprising a pair of lateral extensions that attach to one of each of the longitudinal sides of the top section of the frame in the first state to increase the lateral width of the frame with a plurality of attachable boards extending across and attachable to each of the lateral extensions for receiving a mattress thereon; and a second state comprising a separately, selectably attachable head-foot module comprising a bottom section, legs extending downward from the bottom section that are combinable, directly to the top section of the frame in the second state, and a head section and a foot section each independently adjustable with respect to each other with respect to the bottom section of the head-foot module and with respect to the top section of the frame, wherein the separately, selectably attachable platform is removed from the frame in the second state and wherein the head-foot module is removed from the frame in the first state.

15. The modular high-low bed of claim 14, further comprising a wheel combined to a rod which is fixed to one of each respective end of the two pairs of hinged cross bars wherein the wheel is engaged in the slide.

16. The modular high-low bed of claim 15, further comprising a cylinder combined at one end to a first cross bar extending between the two pairs of hinged cross bars and at the other end to a second cross bar extending opposing slides on one side of the bottom-frame section of the frame.

17. The modular high-low bed of claim 14, wherein the separately, selectably attachable head-foot module further comprises a head section and a foot section combined together by a hinge that allows the head section and the foot section to pivot on top of each other for shipping in a more compact space, wherein the separately, attachable head-foot module further comprises of a locking mechanism to lock the head section and the foot section together to increase a load capacity of the separately, selectably attachable head-foot module.

18. The modular high-low bed of claim 14, wherein only one of the separately, selectably attachable platform and the separately, selectably attachable head-foot module is combined to the frame at a time.

* * * * *